US012264423B2

(12) United States Patent
Lonati et al.

(10) Patent No.: US 12,264,423 B2
(45) Date of Patent: Apr. 1, 2025

(54) CIRCULAR HOSIERY KNITTING MACHINE FOR MANUFACTURING TUBULAR ITEMS

(71) Applicant: Lonati S.P.A, Brescia (IT)

(72) Inventors: Ettore Lonati, Botticino (IT); Fausto Lonati, Brescia (IT); Francesco Lonati, San Felice del Benaco (IT)

(73) Assignee: Lonati S.P.A., Brescia (IT)

( * ) Notice: Subject to any disclaimer, the term of this patent is extended or adjusted under 35 U.S.C. 154(b) by 0 days.

(21) Appl. No.: 17/755,699

(22) PCT Filed: Mar. 5, 2021

(86) PCT No.: PCT/EP2021/055601
§ 371 (c)(1),
(2) Date: May 5, 2022

(87) PCT Pub. No.: WO2021/190900
PCT Pub. Date: Sep. 30, 2021

(65) Prior Publication Data
US 2023/0002940 A1 Jan. 5, 2023

(30) Foreign Application Priority Data
Mar. 24, 2020 (IT) ..... 102020000006142

(51) Int. Cl.
*D04B 9/40* (2006.01)
*D04B 9/46* (2006.01)
*D04B 15/99* (2006.01)

(52) U.S. Cl.
CPC ..... *D04B 9/40* (2013.01); *D04B 9/46* (2013.01); *D04B 15/99* (2013.01)

(58) Field of Classification Search
CPC . D04B 9/40; D04B 9/46; D04B 15/88; D04B 15/99; D04B 15/02; D04B 15/94; D04B 27/34
See application file for complete search history.

(56) References Cited

U.S. PATENT DOCUMENTS

2001/0017047 A1* 8/2001 Ando' ..... D04B 15/02 66/58
2002/0000106 A1* 1/2002 Sangiacomo ..... D04B 9/46 66/58

(Continued)

FOREIGN PATENT DOCUMENTS

CN 102482813 A 5/2012
CN 103249882 A 8/2013

(Continued)

OTHER PUBLICATIONS

Office Action issued by the Bangladesh Patent Office re Bangladesh Patent Application No. 81/2021/2971, dated Sep. 5, 2022 (1 page).

(Continued)

*Primary Examiner* — Aiying Zhao
(74) *Attorney, Agent, or Firm* — Quicker Law, LLC

(57) ABSTRACT

A circular hosiery knitting machine comprising a needle cylinder which can be actuated with a rotary motion about its own axis, arranged vertically, and on the skirt of which there is a plurality of axial grooves, each accommodating a needle, a tubular body being arranged internally and coaxially to the needle cylinder and being adapted to receive the manufactured item during its forming; the tubular body is supported so that it can slide along an axial direction within the needle cylinder; and actuation means which act on command on the tubular body in order to actuate its axial movement with respect to the needle cylinder, the actuation means being associated with means for controlling the speed of the tubular body.

4 Claims, 6 Drawing Sheets

(56) References Cited

U.S. PATENT DOCUMENTS

| | | | | |
|---|---|---|---|---|
| 2004/0211226 | A1* | 10/2004 | Frullini | D04B 15/18 66/147 |
| 2006/0144095 | A1* | 7/2006 | Frullini | D04B 15/18 66/8 |
| 2010/0313607 | A1* | 12/2010 | Lonati | D04B 9/02 66/148 |
| 2010/0319408 | A1* | 12/2010 | Lonati | D04B 15/02 66/149 R |
| 2014/0338401 | A1* | 11/2014 | Lonati | D04B 9/40 66/14 |
| 2015/0000348 | A1* | 1/2015 | Lonati | D04B 9/10 66/8 |
| 2018/0340276 | A1* | 11/2018 | Lonati | D04B 9/40 |
| 2019/0301062 | A1* | 10/2019 | Lonati | D04B 15/02 |
| 2022/0307167 | A1 | 9/2022 | Lonati et al. | |

FOREIGN PATENT DOCUMENTS

| | | | | |
|---|---|---|---|---|
| CN | 107109727 | A | 8/2017 | |
| DE | 2530878 | A1 | 1/1977 | |
| DE | 102016106022 | A1 * | 10/2017 | D04B 15/78 |
| EP | 0942086 | B1 | 5/2004 | |
| EP | 2250305 | A1 | 11/2010 | |
| EP | 2764149 | B1 | 11/2015 | |
| GB | 1047123 | A | 11/1966 | |
| GB | 2151044 | A * | 7/1985 | D04B 1/108 |

OTHER PUBLICATIONS

Office Action issued by the Bangladesh Patent Office re Bangladesh Patent Application No. 274/2022/2970, dated Sep. 5, 2022 (1 page).
Office Action No. 12601 issued by the Colombian Patent Office re Colombian Patent Application No. NC2022/0004705, dated Jul. 24, 2023 (20 pages).
Examination report issued by the Eurasia Patent Office re EAPO Application No. 202291703, dated Nov. 22, 2022 (3 pages with English translation).
Office Action issued by the Bangladesh Patent Office for Bangladesh Patent Application No. 81/2021/2364 dated Jun. 23, 2022, 1 page.
Search Report issued for Italian Patent Application No. IT 202000006142 dated Nov. 9, 2020, 10 pages.
Examination Report issued for Bangladesh Patent Application No. 81/2021 dated Mar. 1, 2022, 1 page.
International Search Report and Written Opinion issued for International Application No. PCT/EP2021/055601 dated Apr. 30, 2021, 11 pages.
Office Action mailed Oct. 26, 2023 in related Chinese application No. 202180006227.5 with English-language translation (14 pages.).
English-language translation of Office Action mailed Feb. 29, 2024 in Egyptian Patent Appl. No. 2022070995 (8 pgs.).
English-language translation of Office Action mailed Apr. 17, 2024 in Brazil Patent Appl. No. 112022007940-0 (4 pgs.).
Office Action mailed Jul. 2, 2024 in related Japanese application No. 2022-546701 with English-language translation (9 pgs.).
English-language translation of Office Action mailed Oct. 1, 2024 in Egyptian Patent Appl. No. 2022070995 (6 pgs.).
Office Action mailed Dec. 10, 2024 in Korean application No. 10-2022-7015413 with English-language translation (15 pgs.).

* cited by examiner

CIRCULAR HOSIERY KNITTING MACHINE FOR MANUFACTURING TUBULAR ITEMS

CROSS-REFERENCE TO RELATED APPLICATIONS

This application is a national phase entry of International Application No. PCT/EP2021/055601 filed Mar. 5, 2021; which claims priority to Italian Application No. 102020000006142 filed Mar. 24, 2020; the disclosures of both of which are incorporated by reference herein in their entirety.

FIELD OF THE DISCLOSURE

The present invention relates to a circular hosiery knitting machine for manufacturing tubular items. In particular, the manufactured tubular items are intended to be transferred to a station for sewing or looping to close one of the axial ends thereof.

BACKGROUND

In the field of manufacturing knitted items with circular knitting machines for hosiery or the like, in some cases there is thus the need to perform a transfer of the manufactured item from the machine used for manufacturing the item to another production unit in order to perform further work on the manufactured item that cannot be performed on said machine or is not economically convenient to perform on said machine.

In particular, in the field of the production of hosiery items, in recent years techniques for performing automatically the closing of their toe by sewing or looping have been developed. Some of these techniques are based on the removal of the manufactured item from the machine used for its production and on its transfer to a station for further work, separate from the production machine, so as to close the toe of the hosiery item in the station for further work while the machine is used for manufacturing another hosiery item. These techniques have the advantage, with respect to other techniques based on closing the toe of the hosiery item directly on the machine used for its production, of not penalizing excessively the productivity of the machine.

The transfer of the hosiery item, or more in general of the tubular item, from the machine used for its production to the station in which the closing of an axial end of the manufactured item or more generally further work on the manufactured item is to be carried out is generally performed by means of a removal device which, by means of removal elements, engages individually the loops of knitting of the manufactured item from the needles of the machine and holds them during the transfer of the manufactured item.

In some techniques for closing the toe of hosiery items, the removal device is used also to support the manufactured item during the execution of the further work, while in other techniques the removal device is used only to perform the transfer of the manufactured item because once it reaches the station in which the further work is to be performed it releases the loops of knitting, previously removed from the needles, to another device that has the function of supporting the manufactured item during the performance of the further work, such as for example a handling device.

Such handling device arranges the loops belonging to one half of the course of knitting received by the removal device so that they face the loops belonging to the other half of the same course of knitting and supports the two partial courses of knitting in a mutually facing position during the intervention of a sewing head or looping head that joins the mutually facing pairs of loops of knitting.

In some removal devices of the known type used to simply transfer the manufactured item from the machine that produces it to a handling device, the coupling between the removal members and the needles, in order to transfer the loops of knitting from the needles to the removal members, occurs usually by means of the insertion of the needle head in a seat formed in the end of the removal member. For this reason, the removal device usually has an annular removal body, which is designed to face coaxially the end of the needle cylinder from which the needle heads protrude and supports a plurality of removal members oriented parallel to the axis of the removal body.

A removal device of this type is described, for example, in EP0942086. Removal devices, described for example in EP2250306, are also known which comprise an annular removal body, which supports removal members which can slide, with respect to the removal body, along radial directions. The removal body can be arranged coaxially around the needle cylinder of a circular knitting machine with each one of the removal members arranged so as to face laterally a corresponding needle of the machine.

In the station for further work there is a handling device which is provided with an annular body arranged so that its axis is vertical. The annular body is provided, on its lower face, with a plurality of spikes which are arranged along an imaginary cylindrical surface having an axis which coincides with the axis and are extended parallel to said axis. The spikes are mutually spaced angularly around the axis uniformly according to an angular spacing which corresponds to the spacing that exists between the removal members of the removal device. In practice, each removal member is matched by a spike of the handling device and when the removal device is arranged in the station for further work, the removal body of the removal device is in a coaxial position with respect to the body of the handling device with the removal members arranged about the annular arrangement of spikes annular portion and with each removal member aligned radially with a spike.

In the transfer of the loops of knitting from the needles to the grip members of the transfer member, the need is felt to be able to actuate a movement of the loops of knitting along the needles while they are kept in a stationary position or when they are moved with respect to the loops of knitting.

Known machines arrange, internally and coaxially to the needle cylinder, a tubular body (also known as goblet) designed to receive the manufacture during its forming.

The upper end of the tubular body is preferably widened like an inverted cone.

The tubular body exits in a lower region from the needle cylinder and can be connected, in a per se known manner, to a suction device in order to draw the manufacture during its forming.

The tubular body is supported, so that it can slide along its axis that coincides with the axis of the needle cylinder, by the supporting structure of the machine and there are actuation means which act on command on the tubular body in order to actuate its axial movement with respect to the needle cylinder.

The tubular body is, in particular, movable on command along its axis that coincides with the axis of the needle cylinder from an inactive position, in which it is arranged with its upper end at the same level or at a lower level with respect to the upper end of the needle cylinder, to at least one active position, in which it protrudes with its upper end from the upper end of the needle cylinder.

In currently known solutions, the actuation means that act on command on the tubular body in order to actuate its axial movement from the inactive position to one or more active positions are conveniently constituted by at least one fluid-operated cylinder with a vertical axis, which is mounted on a supporting element and acts with the stem of its piston on a flange that is integral with the tubular body.

The solution described above, while being widely used, is not however free from drawbacks.

In particular, the movement of the tubular body by means of a fluid-operated cylinder causes an extremely rapid lifting of the manufactured item along the needles, which can cause, in some operating methods, a less than perfect mutual arrangement between the needles and the loops in the step for preparation for transfer, with consequent defects of the manufactured item.

In particular, the extremely rapid lifting of the manufactured item can cause, in some situations and with certain types of yarn, an incorrect mutual arrangement between the loops and the transfer members, compromising indeed the transfer of the manufactured item.

SUMMARY

The aim of the present invention is to provide a circular hosiery knitting machine for manufacturing tubular items that is capable of improving the background art in one or more of the above mentioned aspects.

Within this aim, an object of the invention is to provide a circular hosiery knitting machine for manufacturing tubular items that allows to manage the lifting of the tubular body as a function of the type of product and of the yarn used.

Another object of the invention is to provide a circular hosiery knitting machine for manufacturing tubular items that is highly reliable, relatively easy to provide and at competitive costs.

This aim and these and other objects which will become better apparent hereinafter are achieved by a circular hosiery knitting machine for manufacturing tubular items according to claim 1, optionally provided with one or more of the characteristics of the dependent claims.

BRIEF DESCRIPTION OF ILLUSTRATIVE DRAWINGS

Further characteristics and advantages of the invention will become better apparent from the description of a preferred but not exclusive embodiment of the circular hosiery knitting machine for manufacturing tubular items according to the invention, illustrated by way of non-limiting example in the accompanying drawings, wherein.

DETAILED DESCRIPTION OF ILLUSTRATIVE ASPECTS

Figure 1:
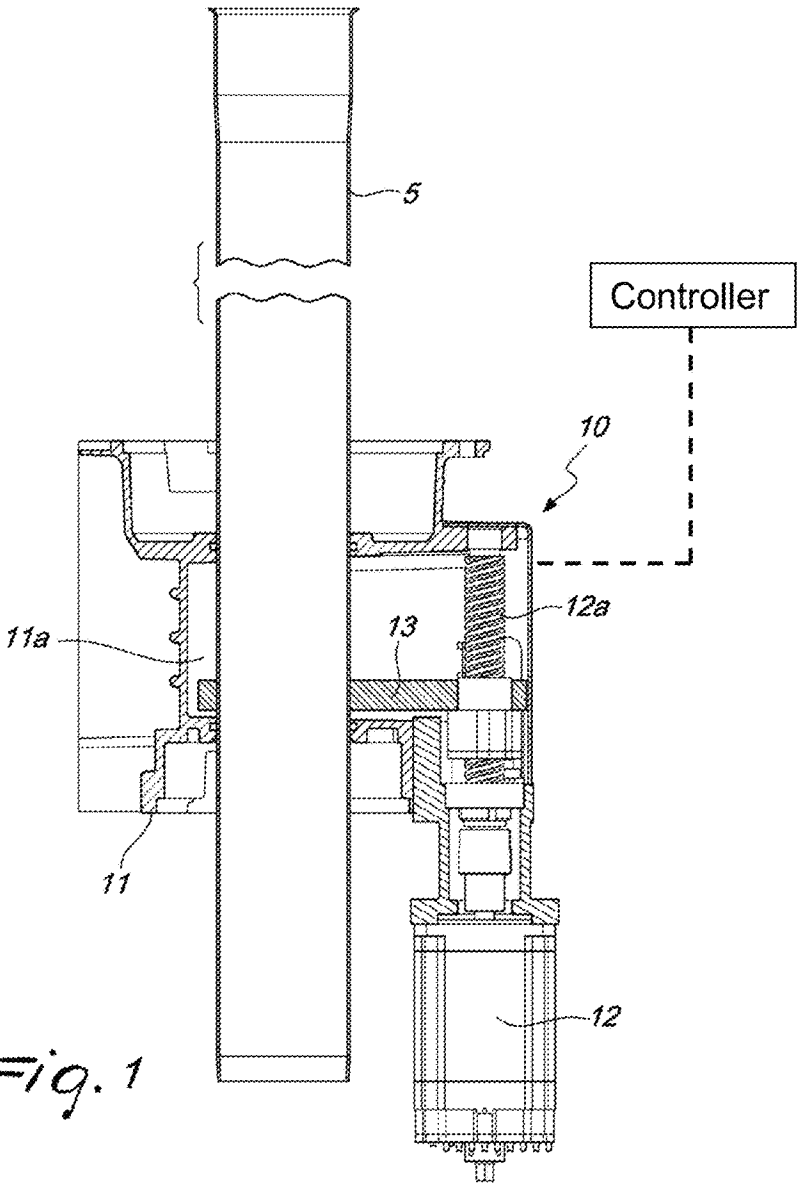
FIG. 1 is a schematic axial sectional view of the tubular body and of its actuation means of the machine according to the present invention.
Figure 2:
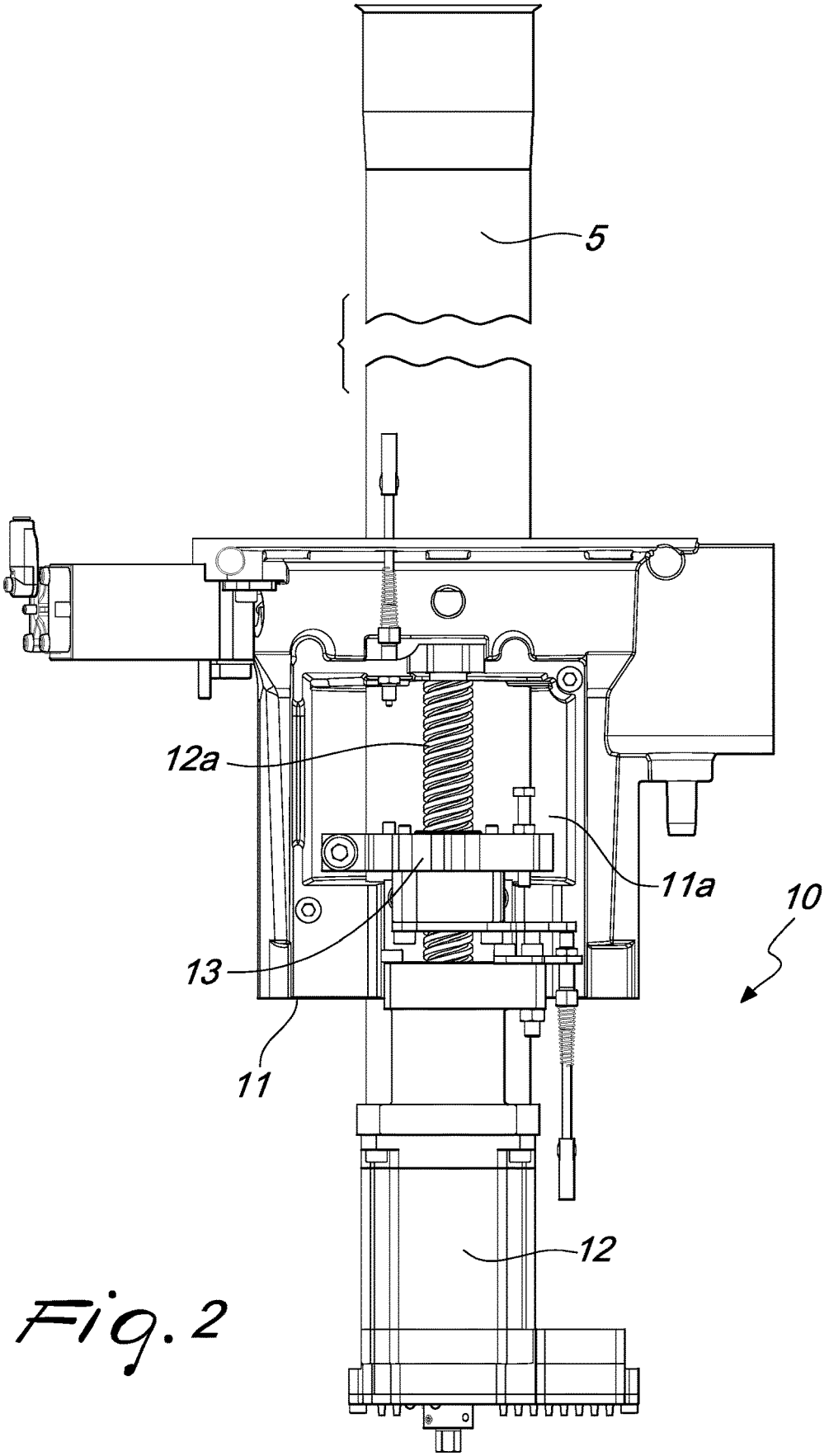
FIG. 2 is a lateral elevation view of the machine portion of FIG. 1.

With reference to the figures, the machine according to the invention, generally designated by the reference numeral 1, comprises, in a per se known manner, a needle cylinder 2, which can be actuated with a rotary motion about its own axis 2*a*, which is vertical, and on the skirt of which there is a plurality of axial grooves 3, each accommodating a needle 4 which can be actuated along the corresponding axial groove 3 in order to produce knitting.

Internally or coaxially to the needle cylinder 2 there is a tubular body 5 designed to receive the manufactured item 40 during its forming.

The upper end of the tubular body 5 is preferably wider like an inverted cone.

The tubular body 5 exits in a lower region from the needle cylinder 2 and can be connected, in a per se known manner, to a suction device in order to draw the manufactured item 40 during its formation.

The tubular body 5 is supported, so that it can slide along its axis that coincides with the axis 2*a*, by the supporting structure of the machine and there are first actuation means 10 which act on command on the tubular body 5 in order to actuate its axial movement with respect to the needle cylinder 2.

Figure 3:
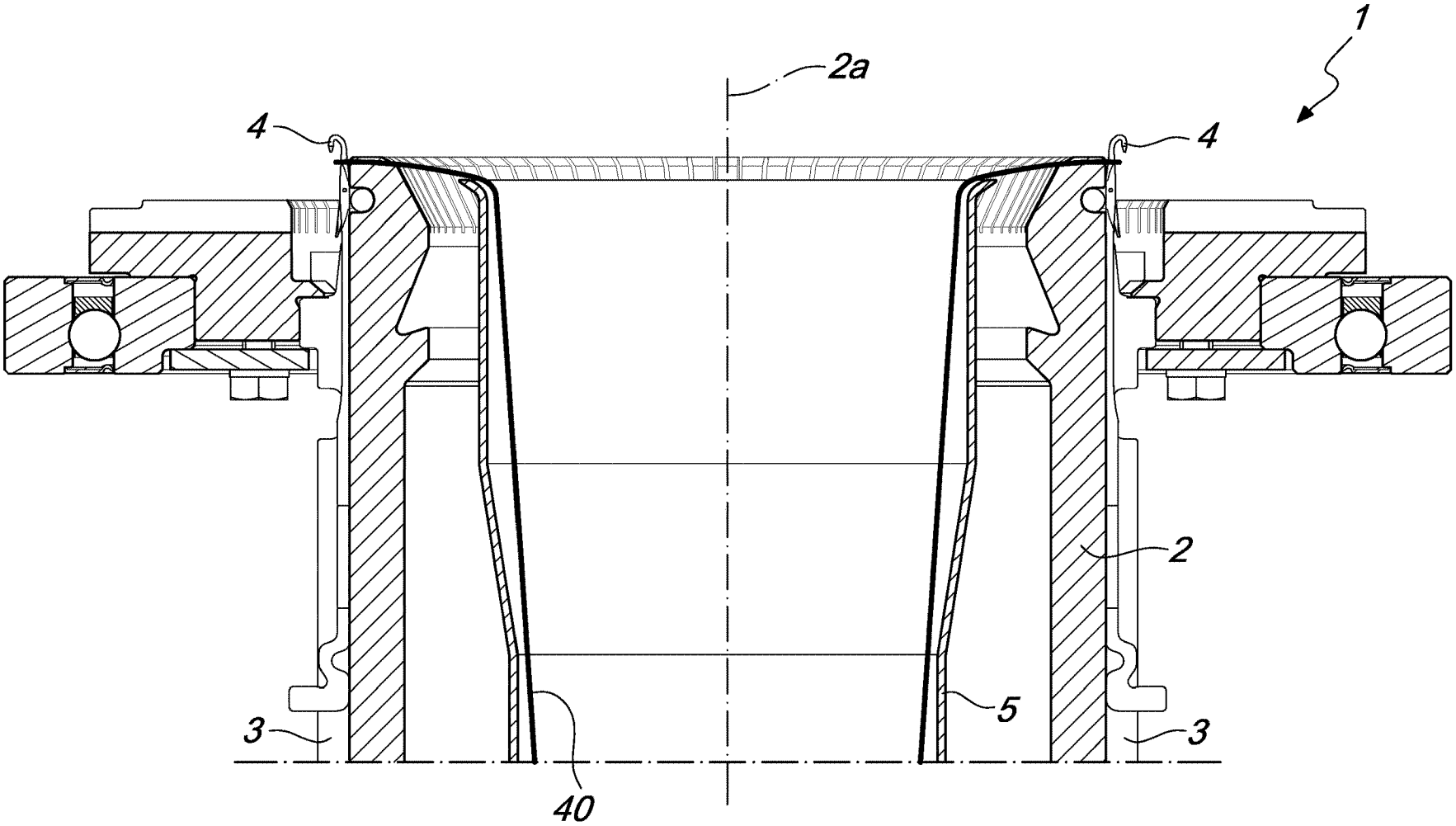
FIG. 3 is an enlarged-scale view of a detail of the upper end of the needle cylinder of the machine according to the invention in an operative condition.
Figure 4:
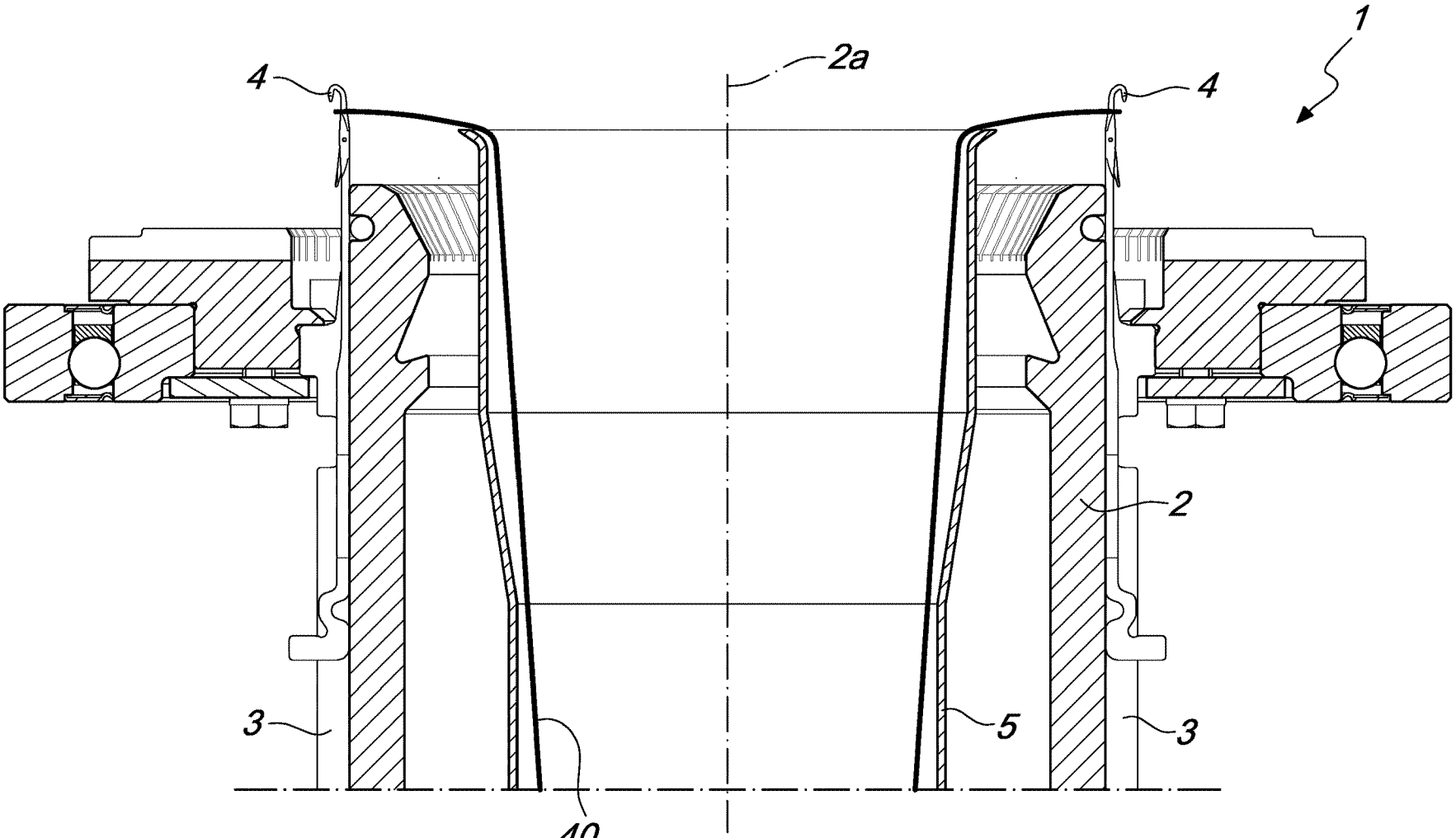
FIGS. 4 to 6 are views of the same detail of FIG. 3 in another operative condition.
Figure 5:
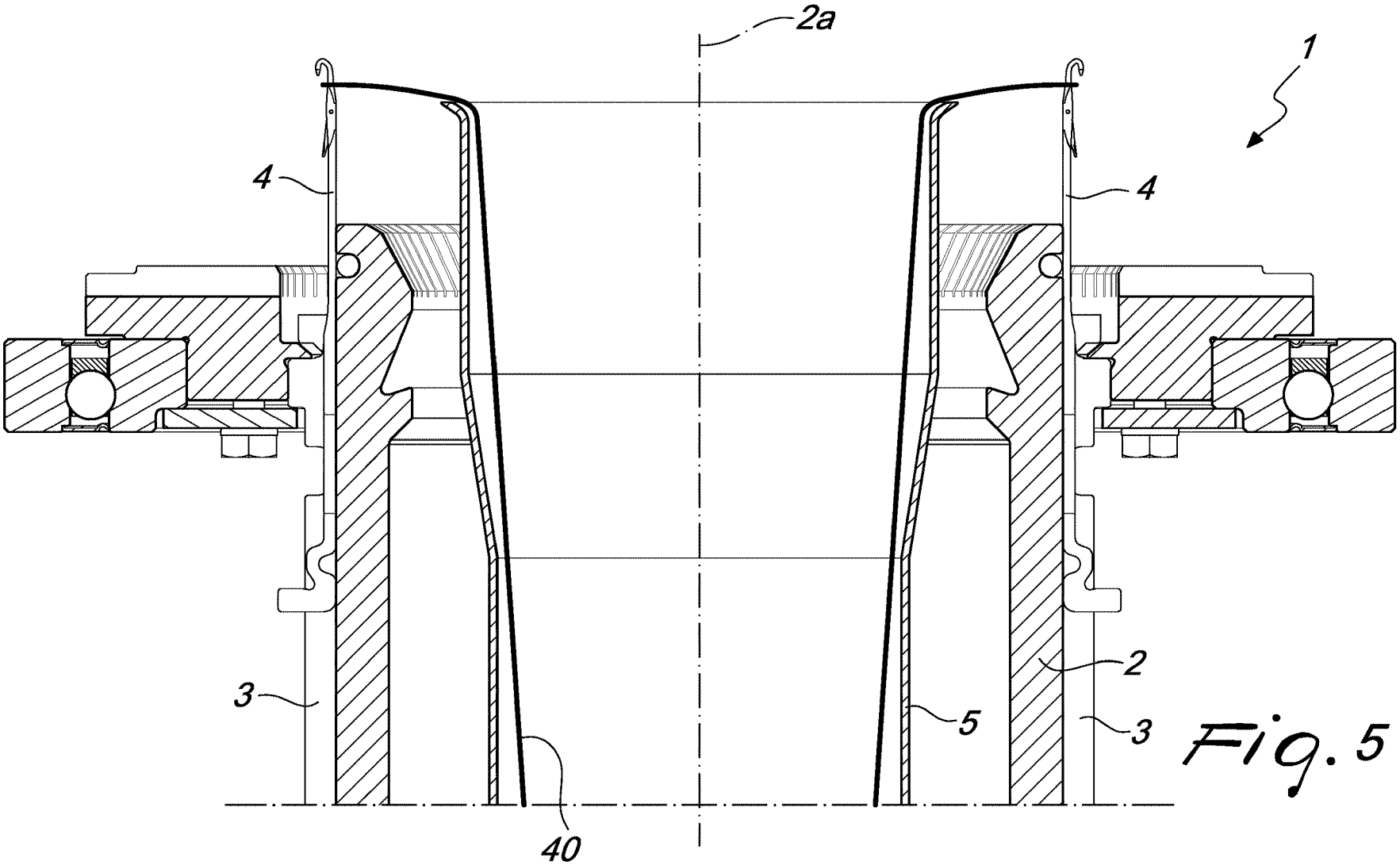
Figure 6:
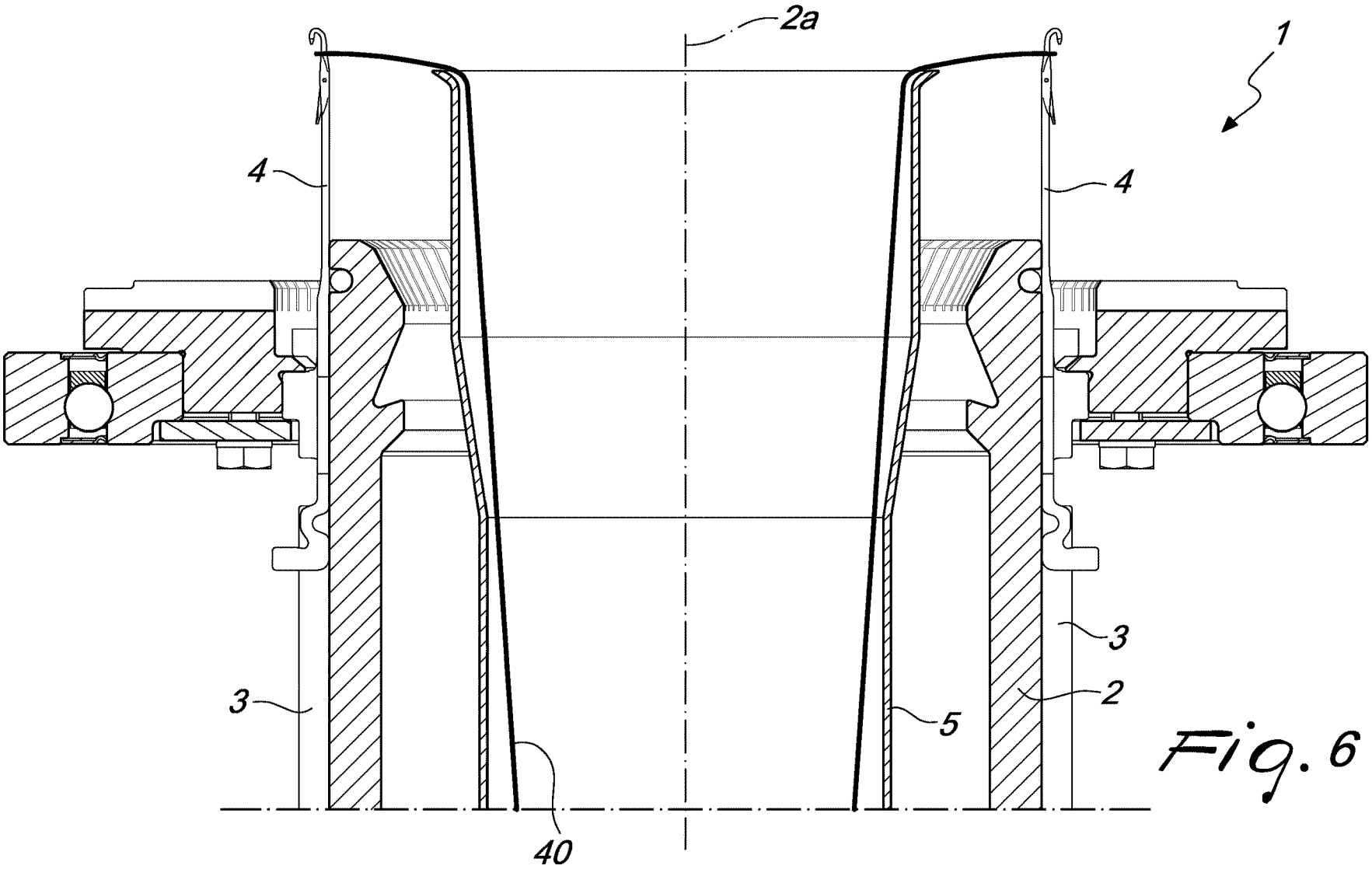

The tubular body 5 is movable on command along its axis that coincides with the axis 2*a*, with respect to the needle cylinder 2, from an inactive position, in which it is arranged with its upper end at the same level or at a lower level with respect to the upper end of the needle cylinder 2, as shown in FIG. 3, to at least one active position, in which it protrudes with its upper end from the upper end of the needle cylinder 2, as shown in FIGS. 4, 5 and 6.

Preferably, the tubular body 5 is movable on command from the inactive position to multiple active positions, in which it protrudes with its upper end from the upper end of the needle cylinder by mutually different extents.

By way of example, FIG. 4 shows a first active position which is a "tuck stitch" position, FIG. 5 shows a second active position which is a "drop stitch" position, and FIG. 6 shows a third "heel bypass" active position.

More particularly, around a lower portion of the tubular body 5 which is arranged below the needle cylinder 2 there is a supporting element 11 which is integral with the supporting structure of the machine, at least as regards its translation along the axis 2*a*, and is crossed by a cylindrical seat 11*a*, with an axis that coincides with the axis 2*a*, which supports, so as to allow sliding along its own axis, the tubular body 5.

The actuation means 10 are associated with a controller for controlling the speed of the tubular body 5 along its axial movement from said inactive position to said at least one active position.

In particular, the actuation means 10 comprise a motor 12 adapted to actuate in a controlled manner the axial movement of the tubular body 5 from the inactive position to the at least one active position.

Conveniently, the controller controls the speed of the tubular body 5 along its axial movement from the inactive position to the at least one active position as a function of the corresponding rotation rate of the cylinder during the needle lifting step.

According to one possible practical embodiment, the controller is associated with programming means.

The controller may also be associated with sensor means associated with the needle cylinder 2 and adapted to control the motor 12 as a function of the position of the needles 4.

According to one practical embodiment, the motor 12 comprises an electric motor which has an output shaft 12*a* constituted by a worm screw which meshes with a block 13 that is integral with the tubular body 5.

Different connection means may be provided between the motor 12 and the tubular body 11, which are adapted in any case to allow a movement in a controlled manner of the tubular body 5 from the inactive position to the at least one active position.

The operation of the machine according to the invention, as regards the movement of the tubular body 5, is as follows.

During normal work of the machine, the tubular body 5 is in the inactive position, shown in FIG. 3, i.e., with its upper end arranged substantially at the same level or at a lower level with respect to the level of the upper end of the needle cylinder 2.

When one wishes to exert on the manufactured item 40 an action that is directed upward so as to cause its rise along the needle 4, such as for example when one wishes to transfer the loops arranged on the needles 4 from the needles 4 to the grip members of a transfer member, as described above, it is possible to actuate the motor 12, which cause the lifting of the tubular body 5 at a controlled speed and by the desired quantity.

FIGS. 4 to 6 shown three different degrees of lifting of the tubular body 5 with respect to the needle cylinder 2.

When one wishes to return the tubular body 5 to the inactive position, it is sufficient to actuate the actuation means in the opposite direction.

By way of example, with reference to the type of machine shown in the figures, at the end of the knitting of the manufactured item 40 all the needles 4 are in the so-called "float stitch" or "under sinker" (FIG. 3) position and the tubular body 5 is in its lowest position, the one used during the knitting of the tubular manufactured item 40.

This position is substantially common for all the types of machines that perform methods intended to perform a closed toe with removal for sewing on devices external to said machine.

At this point, a cam reaches the active position and begins to lift the needles 4, bringing them to the "tuck stitch" position (FIG. 4).

According to the present invention, the actuation means 10 are actuated, in a controlled manner, in order to lift the tubular body 5 so as to maintain the loops in a safety condition.

In fact, if the loops were too low in this step there would be the risk that they might end up under the latch, while if they were too high they might exit from the head of the respective needle 4.

Once leveling in the "tuck stitch" position has been completed, another cam is actuated and moves the needles 4 to the "drop stitch" position (FIG. 5).

During this step, the tubular body 5 continues its movement at a controlled speed in order to keep the loops of knitting in the previously described condition.

Once leveling in the "drop stitch" position has been completed, it is possible to provide for another cam to become active in order to move the needles 4 to the "heel bypass" position (FIG. 6).

If the "heel bypass" position is actually provided, the tubular body 5 is actuated further in order to perform an upward movement at a controlled speed so as to keep the loops of knitting in the previously described condition.

When all the needles 4 are in the "heel bypass" position the intervention of the tubular body 5 necessary to keep the loops of knitting in the transfer position is finished.

The movement sequence of the needles 4 described above is merely an example, although most machines 1 that provide for the transfer of the tubular manufacture perform substantially the same sequence except, in some cases, for the movement in the "heel bypass" position.

Although the machine according to the invention has been conceived in particular to simplify and increase the speed of the operations for automated transfer of a manufacture of the circular knitting machine that produces it to a machine capable of performing sewing or looping for closing an axial end of said manufacture, particularly for manufacturing hosiery items, it may be used in any case advantageously in any situation which requires a movement of the manufacture along the needles with which it is engaged.

In practice it has been found that the machine according to the invention fully achieves the intended aim and objects, since by allowing to move the manufactured item along the stem of the needles with which the manufactured item is engaged it simplifies and increases the speed of the operations for the automated transfer of the manufactured item from the knitting machine to a transfer member to be used for performing, externally from said machine, the sewing and looping operation for closing an axial end of said manufactured item.

The invention thus conceived is susceptible of numerous modifications and variations, all of which are within the scope of the appended claims; all the details may furthermore be replaced with other technically equivalent elements.

In practice, the materials used, so long as they are compatible with the specific use, as well as the contingent shapes and dimensions, may be any according to the requirements and the state of the art.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A circular knitting machine comprising a needle cylinder which can be actuated with a rotary motion about an axis thereof, arranged vertically, and on a skirt of which there is a plurality of axial grooves, each accommodating a needle, a tubular body being arranged internally and coaxially to said needle cylinder and being configured to receive an item during a process of forming the item, said tubular body being supported so that it can slide along an axial direction of said tubular body within said needle cylinder in order to pass from at least one inactive position, in which the tubular body is arranged with an upper end thereof at a same level or at a lower level with respect to an upper end of the needle cylinder, to at least one active position, in which the tubular body protrudes with its upper end from the upper end of the needle cylinder, actuation means being provided which are configured to act on command on said tubular body in order to actuate an axial movement of said tubular body with respect to said needle cylinder, wherein said actuation means are associated with a controller that is configured to control a speed of said tubular body along its axial movement from said inactive position to said at least one active position, wherein said actuation means comprise a motor adapted to actuate in a controlled manner the axial movement of said tubular body from said inactive position to said at least one active position, and wherein the controller is configured to control the speed of said tubular body along its axial movement from said inactive position to said at least one active position as a function of a corresponding rotation rate of the needle cylinder.

2. The circular knitting machine according to claim 1, wherein said controller is programmable.

3. The circular knitting machine according to claim 1, wherein said motor comprises an electric motor which has an output shaft which comprises a worm screw which meshes with a block that is integral with said tubular body.

4. The circular knitting machine according to claim 1, wherein said circular kitting machine further comprises sensor means associated with said needle cylinder, and said controller is programmed to control said motor as a function of the position of said needles.

* * * * *